US006363867B1

(12) United States Patent
Tsilevich

(10) Patent No.: US 6,363,867 B1
(45) **Date of Patent: *Apr. 2, 2002**

(54) STRUCTURAL PROTECTIVE SYSTEM AND METHOD

(76) Inventor: Maoz Betzer Tsilevich, Moshav Mishmar Hashivah 110 (IL)

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 0 days.

(21) Appl. No.: 08/813,214

(22) Filed: Mar. 7, 1997

(51) Int. Cl.[7] ..... E06B 9/00

(52) U.S. Cl. ..... 109/49.5; 89/36.02; 89/36.04; 109/81; 109/83; 109/84

(58) Field of Search ..... 109/49.5, 80–85; 89/36.02, 36.04

(56) References Cited

U.S. PATENT DOCUMENTS

| | | | | | |
|---|---|---|---|---|---|
| 63,046 | A | * | 3/1867 | Hendrickson | 109/85 |
| 604,940 | A | * | 5/1898 | Matthews | 89/36.02 X |
| 712,605 | A | * | 11/1902 | Shaaber | 89/36.02 X |
| 1,236,033 | A | * | 8/1917 | Almengual | 89/36.02 X |
| 1,277,859 | A | * | 9/1918 | Cieszkowski | 109/82 |
| 1,354,671 | A | * | 10/1920 | Magnuson | 109/82 X |
| 1,703,416 | A | * | 2/1929 | Donaldson | 109/82 X |
| 2,077,729 | A | * | 4/1937 | Wilcox | 109/81 |
| 2,399,691 | A | * | 5/1946 | Partiot | 109/85 |
| 2,405,590 | A | * | 8/1946 | Mason | 109/81 |
| 2,867,112 | A | * | 1/1959 | Krone | 109/83 |
| 3,205,841 | A | * | 9/1965 | Shwayder | 109/82 |
| 3,779,715 | A | * | 12/1973 | Wendler et al. | 109/84 X |
| 4,104,062 | A | * | 8/1978 | Weaver | 109/84 X |
| 4,364,300 | A | * | 12/1982 | Pagano et al. | 109/85 X |
| 5,149,910 | A | * | 9/1992 | McKee | 109/82 X |
| 6,240,858 | B1 | * | 6/2001 | Mandall | 109/49.5 |

FOREIGN PATENT DOCUMENTS

| | | | | |
|---|---|---|---|---|
| CH | 679244 | * | 1/1992 | 89/36.02 |
| DE | 364574 | * | 11/1921 | 109/81 |
| DE | 2424098 | * | 11/1975 | 89/36.02 |
| DE | 3241526 | * | 12/1983 | 109/84 |
| FR | 2365680 | * | 5/1978 | 109/83 |
| GB | 535638 | * | 4/1941 | 89/36.02 |
| GB | 1584744 | * | 2/1981 | 109/82 |

* cited by examiner

*Primary Examiner*—Lloyd A. Gall
(74) *Attorney, Agent, or Firm*—Harrison & Egbert

(57) ABSTRACT

A barrier to penetration by a foreign object includes a rigid housing and a mechanism, enclosed within the housing, for mechanically trapping the foreign object, for example by exerting a lateral compressional force on the foreign object. The mechanism may include one or more longitudinally compressed elements such as elastomeric blocks or springs, and folded strip of shape memory material that straightens when heated.

20 Claims, 5 Drawing Sheets

STRUCTURAL PROTECTIVE SYSTEM AND METHOD

FIELD AND BACKGROUND OF THE INVENTION

The present invention relates to a system and method for preventing penetration to a secure area and, more particularly, to a system that automatically and reactively opposes such penetration.

Many methods are known for designing enclosures, such as safes and secure rooms, in a way that inhibits their penetration by intruders. Generally, these designs rely on passive inhibition of penetration. Representative components of passively protective enclosure walls include tough internal elements such as alloyed, hardened or carburized steel, or pieces of a ceramic such as carborundum, intended to obstruct drilling; bound elements such as combined metals, various types of concrete, etc.; materials of high thermal conductivity, such as aluminum or copper, intended to resist thermal break-in by conducting the heat away—for example, aluminum or copper fins that conduct the heat to the inner surface of the wall—and thereby not allow the temperature to reach the melting point; and heat-insulating materials. Representative patents in the field include U.S. Pat. Nos. 4,505,208 and 4,765,254, to Goldman; U.S. Pat. No. 4,696,250, to Maxeiner; German Patent No. 25 25 738, to Danzer; and German Patent No. 44 15 986, to Leine et al.

German Patent No. 28 21 281, to Bardehle et al., discloses a safe wall with explosive pellets placed inside and intended to explode in case of an attempted break-in. This design has the advantage over the traditional passive designs that it is reactive. It has the disadvantage, in most civilian applications, of possibly injuring the intruder and damaging the surrounding property in the course of deterring penetration.

There is thus a widely recognized need, and it would be highly advantageous to have, a reactive barrier to penetration that does not suffer from the disadvantages of presently known systems.

SUMMARY OF THE INVENTION

According to the present invention there is provided a barrier resistant to penetration by a burglary tool comprising: (a) a rigid housing; and (b) a mechanism for mechanically trapping the foreign object, enclosed within the housing.

According to the present invention there is provided a method of inhibiting penetration of a secured space by a burglary tool applied substantially perpendicular to its direction of penetration comprising the step of automatically applying a lateral compressive force to the burglary tool, thereby trapping the burglary tool.

The principle of the present invention is illustrated in FIG. 1. A rigid housing 10 is penetrated by a foreign object 12 such as a cutting tool. Housing 10 contains a mechanism for exerting a lateral pre-compressive force on burglary tool 12. This lateral compressive force is represented in FIG. 1 by arrows 14. The lateral compressive force traps burglary tool 12, and stops its motion, thus making it difficult for the intruder to either penetrate further into housing 10 or withdraw burglary tool 12 from housing 10. For reference in the description below, double headed arrow 16 defines the longitudinal direction with respect to housing 10.

Typically, housing 10 is a steel tube sealed at both ends. Devices of the type illustrated in FIG. 1 may be used as such, for example as bars of prison cells. In most applications, however, an array of devices of the type illustrated in FIG. 1 is included in a wall, along with some of the conventional, passive anti-penetration systems described above. Because these devices are not used alone in most applications, they are referred to herein as "barrier components".

An important aspect of the present invention is the optional reliance on the "shape memory" property of certain alloys. Most elastic materials, when subjected to a stress that exceeds their elastic limits, do not return to their original dimensions and shape. Some alloys, that exhibit the shape memory property, can be restored to their original shape by heating. Many of these alloys are characterized by a martensitic phase transition at a certain transition temperature. Examples of such alloys include titanium-nickel, iron-manganese, titanium-nickel-palladium, copper-aluminum-zinc and copper-aluminum-nickel. Alloys of this type, for industrial applications, are produced, for example, by Special Metals Corp. of New Hartford N.Y.

BRIEF DESCRIPTION OF THE DRAWINGS

The invention is herein described, by way of example only, with reference to the accompanying drawings, wherein.

DESCRIPTION OF THE PREFERRED EMBODIMENTS

The present invention is of a barrier component that reactively inhibits penetration by a burglary tool. Specifically, the present invention can be used to inhibit penetration of secured areas by intruders.

The principles and operation of a reactive barrier according to the present invention may be better understood with reference to the drawings and the accompanying description.

Figure 1:
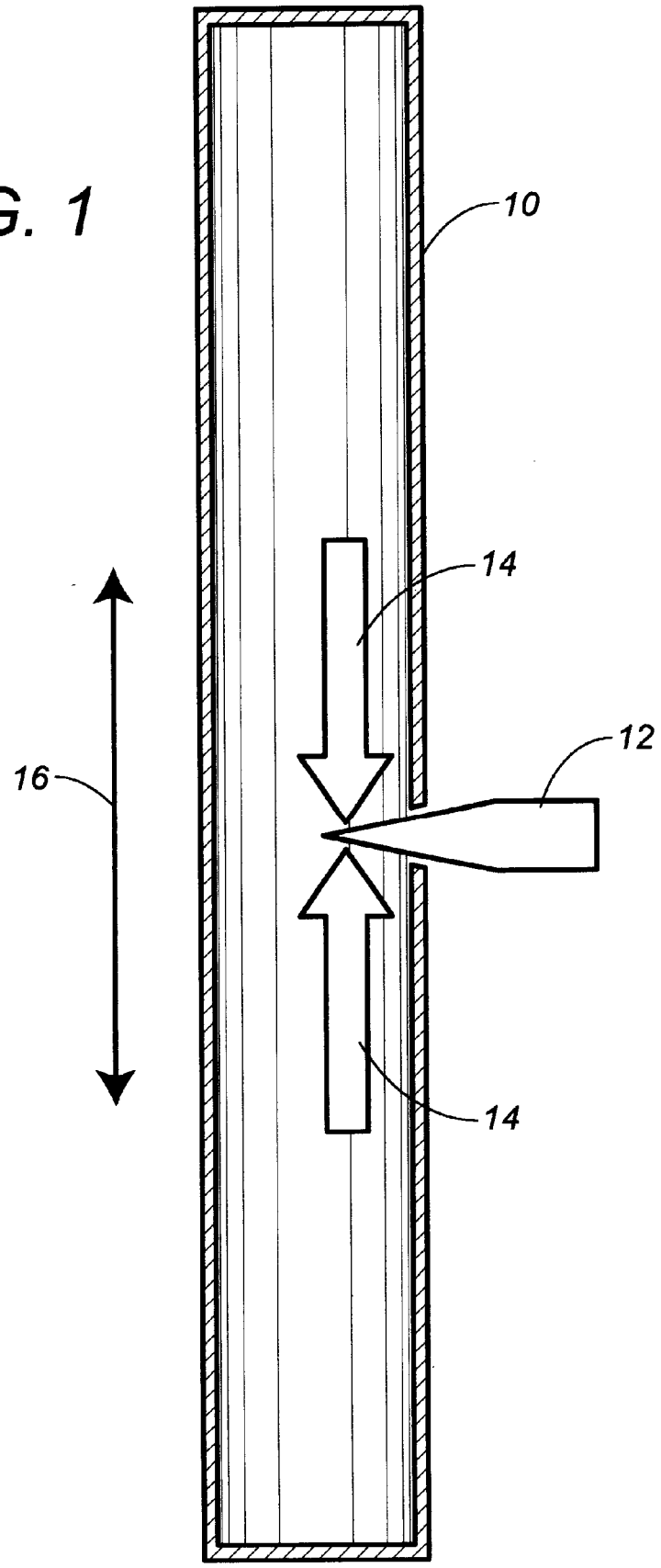
FIG. 1 illustrates the principle of the present invention.
Figure 2:
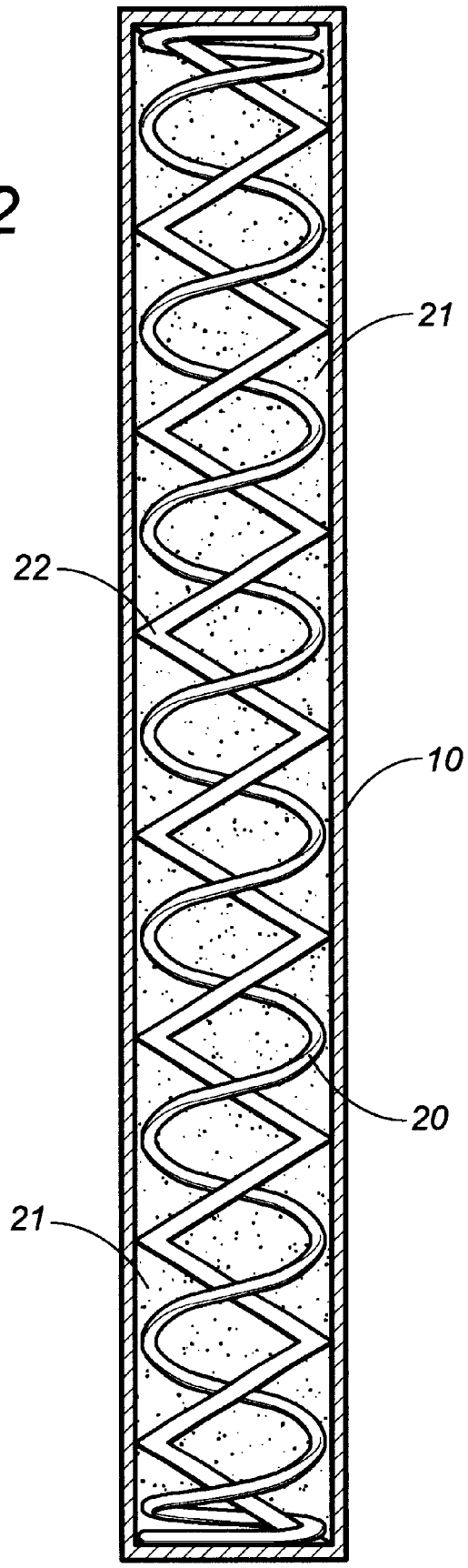
FIG. 2 is a schematic longitudinal cross section of a barrier component.

Referring now to the drawings, FIG. 2 shows one preferred embodiment of a barrier component according to the present invention. Housing 10 is a steel tube of substantially circular cross section. Within housing 10 is a helical steel spring 20, surrounding a strip 22 of a nickel-titanium shape memory alloy.

Spring 20 is compressed in the longitudinal direction within housing 10, with a force of about 3000 Newtons, before sealing the ends of housing 10. Spring 20 is an illustrative example of a longitudinally compressed element as the main component of the trapping mechanism of the present invention. The scope of the present invention includes springs of various types, various sections (circular, rectangular, square, triangular, etc.), made of any suitable material, and subjected to various kinds of treatment (heat treatment, hardening, chrome plating, etc.). The trapping mechanism of the present invention may include several concentric springs.

Strip 22 is bent in a zigzag shape, as shown. When strip 22 is heated above its transition temperature (generally between 80° C. and 140° C.), strip 22 tries to regain the flat shape it had prior to being bent. Thus, strip 22 resists a combination of penetration by foreign object 12 and external heating. This combination of spring 20 and strip 22 within housing 10 provides synergy: spring 20 provides protection against penetration without external heating, and strip 22 provides additional protection against penetration accompanied by external heating.

The space within housing 10 not occupied by spring 20 and strip 22 is loosely filled with a powdered material 21 that has the property of solidifying upon being heated. Powdered material 21 provides further protection against penetration of housing 10 by a heating device such as an oxygen torch or cutting electrodes. Powdered material 21 fills housing 10 loosely enough not to interfere with the motion of spring 20 and strip 22. Upon being heated, however, powdered material 21 is transformed to a solid block that resists penetration by further heating. This delays the intruder by forcing him to switch to a cutting tool such as foreign object 12, which, of course, then is trapped by spring 20. Preferably, powdered material 21 is transformed to a solid block at a temperature higher than the transition temperature of strip 22.

An illustrative example of a suitable powdered material is a powdered material having the following composition:

| | |
|---|---|
| melamine powder | 1%–2% |
| aluminum sulfate | 10%–20% |
| powdered refractory brick | 45%–65% |
| sodium silicate powder | 10%–15% |
| copper powder | 5%–8% |
| borax powder | 10%–15% |

Preferably, the size range of the powder particles is between about 50 microns and about 300 microns.

Alternatively, the space within housing 10 not occupied by spring 20 and strip 22 may be filled with a viscous material that has the property of turning rigid upon being heated. In its viscous state, the viscous material allows spring 20 and strip 22 enough freedom of motion to trap foreign object 12. After being transformed to a rigid state, the formerly viscous material resists penetration by a heating device in the manner of solidified powdered material 21. A suitable viscous material may be compounded of graphite grease, 10% to 40% ammonium polyphosphate, and as much of powdered material 21 as can be added without increasing the viscosity of the material to the point that it interferes with the motion of spring 20 and strip 22.

Figure 3:
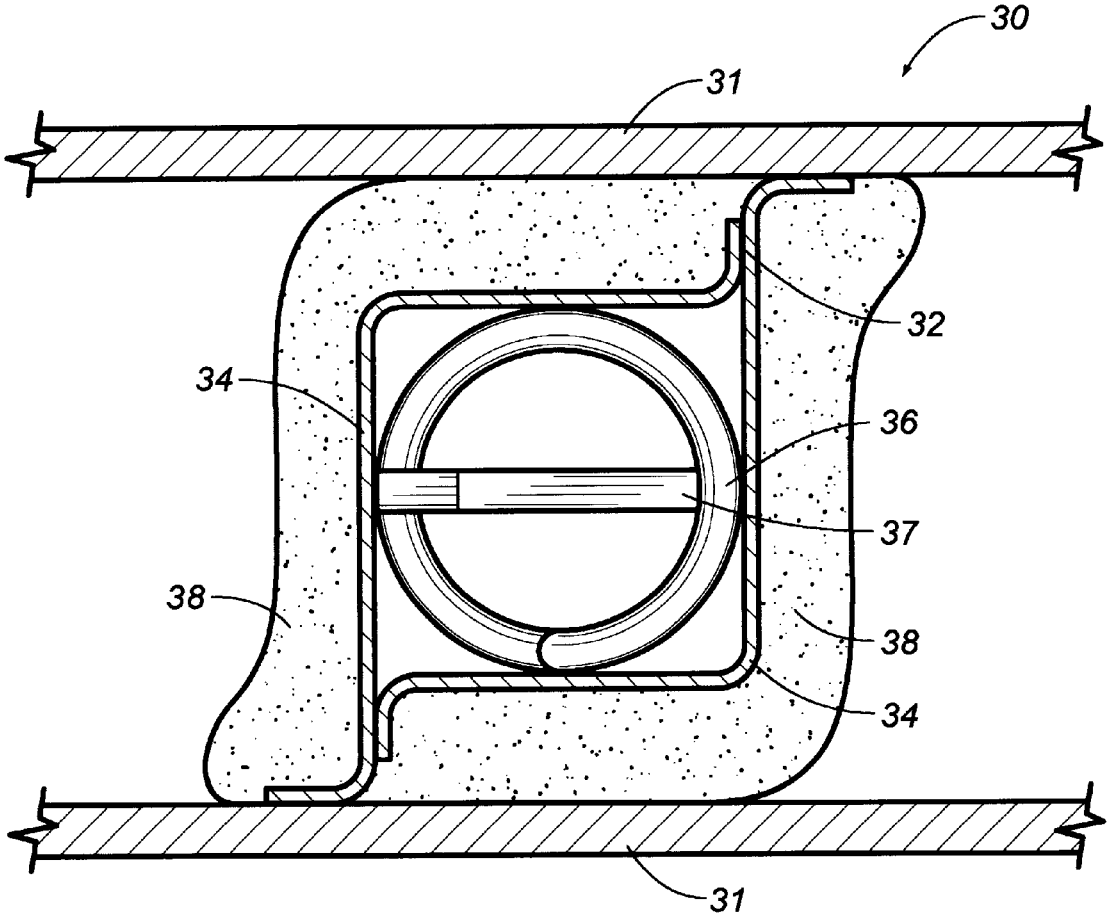
FIG. 3 is a transverse cross section of a variant of the barrier component of FIG. 2.

Housing 10 may be made of any suitable material. Housing 10 also need not be tubular. FIG. 3 shows a transverse cross section of a barrier 30 including a housing 32 made of two bent steel sheets 34 sandwiched between the two walls 31 of barrier 30. As in the embodiment of FIG. 2, a helical spring 36 is compressed longitudinally within housing 32, and a zigzag strip 37 of a shape memory alloy runs longitudinally through spring 36.

Housing 32 is enclosed in a layer 38 of a material that, upon being heated, both reacts endothermically and expands (intumescence). If an intruder attempts to penetrate barrier 30 by heating one of walls 31 opposite layer 38, for example by using a cutting torch, the endothermic reaction of layer 38 tends to absorb the externally imposed heat, and the expansion of layer 38 tends to fill the hole in wall 31 created by the heat. Materials of this type are available commercially, for example the material manufactured by the Fiberite Corporation of Winona MN and sold under the brand name "fiberite".

Figure 4:
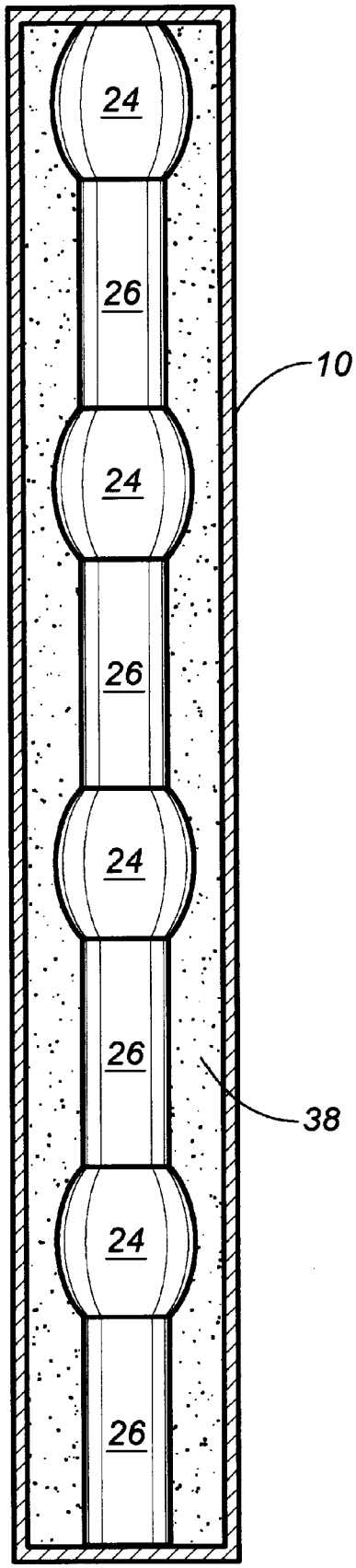
FIG. 4 is a schematic transverse cross section of a second embodiment of a barrier component.

FIG. 4 shows a second preferred embodiment of a barrier component according to the present invention. In this embodiment, the longitudinally compressed elements of the trapping mechanism are compressed blocks 24 of an elastomeric material. Sandwiched between blocks 24, and between the lowermost block 24 and the bottom of housing 10, are rigid steel rods 26. The remainder of the interior of housing 10 is filled with material 38 of FIG. 3.

Figure 5:
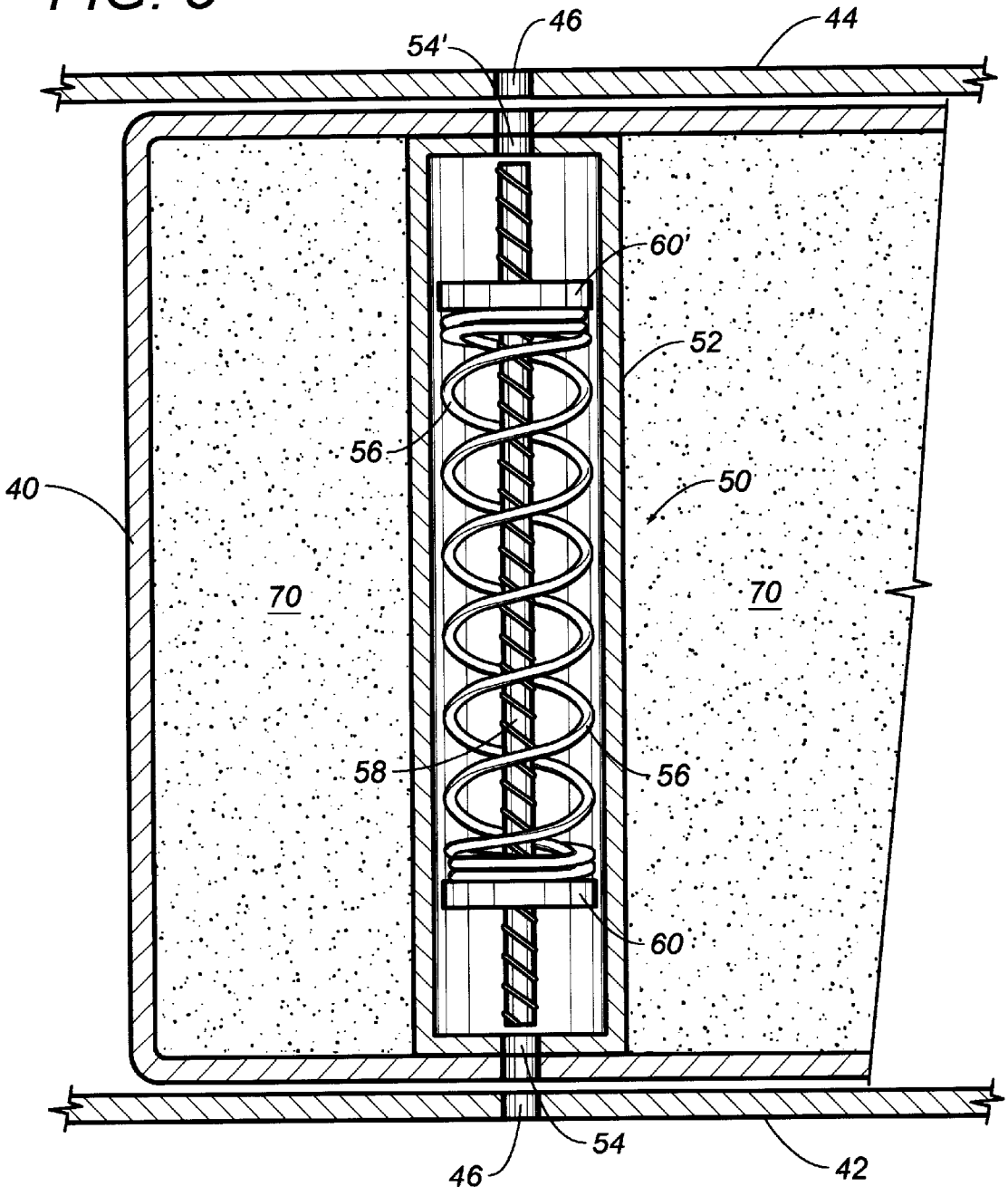
FIG. 5 is a schematic longitudinal cross section through a door incorporating a third embodiment of a barrier component.

FIG. 5 shows a portion of a hollow door 40 incorporating a third preferred embodiment 50 of a barrier component according to the present invention. When closed, door 40 is positioned between a threshold 42 and a lintel 44. Barrier component 50 includes a housing 52 within which two helical springs 56 are compressed longitudinally between two plates 60 and 60' that are rigidly attached to a rigid rod 58. Conversely, rod 58 is held under tension by springs 56. Unlike housing 10, housing 52 has holes 54 and 54' in the ends thereof, opposite hole 46 in threshold 42 and hole 46' in lintel 44, respectively.

An attempt by an intruder to penetrate barrier component 50 using foreign object 12 first encounters lateral compressional forces created by springs 56. Should the intruder succeed in cutting through one of springs 56 and rod 58, the other spring 56 pushes apart the two halves of rod 58, pushing the ends of rod 58 through holes 54 and 54' and into holes 46 and 46', thereby further inhibiting the opening of door 40. FIG. 5 shows two springs 56 for simplicity only. It is preferable to have three or more springs 56 compressed between plates 60 and 60'.

Also for simplicity, FIG. 5 shows only one barrier component 50 within door 40. Preferably, door 40 contains an array of barrier components, of the same type as barrier component 50 and also of the types described elsewhere herein. The space between the barrier components is filled with a passively resistant matrix 70. Examples of materials suitable for matrix 70 include, among thermally insulating materials, ordinary B-300 or B-500 Portland cement, and a heat resistant concrete; and, among thermally conductive materials, a metal, such as aluminum, of high thermal conductivity, high viscosity, and a low enough melting point that it can be melted and poured into door 40 without causing thermal damage to the barrier components. Matrix 70 also may include an endothermically reactive, intumescent material such as those of layer 38 of FIG. 3.

An illustrative example of a suitable heat resistant concrete, featuring considerable strength and excellent adhesion to metal, is of the following composition:

1. Refractory alumina cement with a high alumina content of 72% to 75% and a calcium oxide content of 22% to 25%. Comminution fineness is 4000 $cm^2/g$ to 5000 $cm^2/g$. This cement constitutes 25% to 35% of the total concrete mass.
2. Sodium silicate solution having a specific gravity of 1.35, and a ratio of $SiO_2$ to $Na_2O$ of between 3 and 3.5 by weight. This solution constitutes between 10% and 18% of the total concrete mass, to obtain the necessary liquid consistency for pouring the mixture into door 40.
3. Chamotte aggregate of up to 1.2 mm grain size. The quantity is 50% to 65% of the total concrete mass.
4. Refractory or bentonite clay, constituting between 1% and 2% of the total concrete mass.

In order to increase impact strength, the concrete mix is reinforced with short cuts of high-carbon steel wire, constituting between 2% and 3% of the concrete mass. The wire cuts are 0.5 mm to 1 mm in diameter and up to 10 mm long.

While the invention has been described with respect to a limited number of embodiments, it will be appreciated that many variations, modifications and other applications of the invention may be made.

What is claimed is:

1. An anti-intrusion barrier system comprising:

a non-projectile burglary tool;

a rigid housing having a longitudinal axis; and a trapping means enclosed within said housing for mechanically trapping said burglary tool by applying a primarily lateral compressive force on said burglary tool substantially perpendicular to a direction of travel of the burglary tool, said trapping means comprising at least one elastic element extending in a pre-compressed state along said longitudinal axis of said housing, said at least one elastic element remaining in a compressed state and maintaining an orientation thereof along said longitudinal axis when said burglary tool is trapped.

2. The barrier system of claim 1, wherein said longitudinally compressed element includes an elastomer.

3. The barrier system of claim 1, including two longitudinally compressed elements and a rigid element longitudinally between said two compressed elements.

4. The barrier system of claim 1, including an element held under tension by said longitudinally compressed element.

5. The barrier system of claim 1, further comprising:

(c) a rigid matrix substantially surrounding said housing.

6. The barrier of claim 5, wherein said matrix includes a thermally insulating material.

7. The barrier system of claim 5, wherein said matrix includes a thermally conductive material.

8. The barrier system of claim 5, wherein said matrix includes a material that undergoes an endothermic reaction.

9. The system of claim 1, said housing having a longitudinal axis and a closed cross-sectional profile, said housing being sealed at opposite ends, said at least one elastic element being retained under pressure between said opposite ends in said pre-compressed state.

10. The system of claim 9, said at least one elastic element being laterally confined by said closed cross-sectional profile, said at least one elastic element being expandable in a longitudinal direction.

11. The system of claim 10, said trapping means comprising means for engaging sides of said burglary tool when a portion of said trapping means is removed due to an action of said burglary tool.

12. The system of claim 11, said trapping means comprising means for expanding across the removed portion of said at least one elastic element when the burglary tool is removed.

13. The system of claim 1, said trapping means comprising means for expanding in a longitudinal direction across a portion of said elastic element as removed by said burglary tool.

14. The system of claim 9, said at least one elastic element comprising a spring.

15. The system of claim 9, said at least one elastic element comprising a memory-retention material.

16. The system of claim 11, said means for engaging sides of said burglary tool being a spring.

17. The system of claim 12, said means for expanding across the removed portion being a spring.

18. The system of claim 13, said means for expanding in a longitudinal direction being a spring.

19. A method of inhibiting penetration across a barrier comprising:

forming a non-projectile burglary tool;

forming a rigid housing having a longitudinal axis, including at least one elastic element in a pre-compressed state extending along said longitudinal axis in said housing;

trapping said burglary tool by friction forces from said at least one elastic element in a compressed state; and applying a primarily lateral compressive force onto said burglary tool perpendicular to a direction of movement of said burglary tool across the barrier, said at least one elastic element remaining in a compressed state and maintaining an orientation thereof along said longitudinal axis when said burglary tool is trapped.

20. The method of claim 19, further comprising:

removing a section of said at least one elastic element by said burglary tool; and expanding said at least one elastic element to fill the removed section.

* * * * *